US007238078B2

(12) United States Patent
Kimura

(10) Patent No.: US 7,238,078 B2
(45) Date of Patent: Jul. 3, 2007

(54) AIRPLANE TYPES CHANGEABLE MODEL FLIGHT TOY

(76) Inventor: Noboru Kimura, 7-7-10, Kotsubo, Zushi-shi, Kanagawa-ken (JP)

( * ) Notice: Subject to any disclaimer, the term of this patent is extended or adjusted under 35 U.S.C. 154(b) by 148 days.

(21) Appl. No.: 10/916,660

(22) Filed: Aug. 12, 2004

(65) Prior Publication Data

US 2005/0215168 A1 Sep. 29, 2005

(30) Foreign Application Priority Data

Mar. 26, 2004 (JP) ..... 2004-093707

(51) Int. Cl.
*A63H 27/00* (2006.01)

(52) U.S. Cl. ..... 446/232; 446/93; 446/230

(58) Field of Classification Search ..... 446/30, 446/31, 32, 33, 230, 232, 88, 93, 94; 244/120
See application file for complete search history.

(56) References Cited

U.S. PATENT DOCUMENTS 1,328,134 A * 1/1920 Doelckner ..... 472/6
3,126,667 A * 3/1964 Rabinow ..... 446/94
3,743,279 A * 7/1973 Chang ..... 472/9
3,939,600 A * 2/1976 Eid ..... 446/94
3,963,554 A * 6/1976 Sigafoose ..... 156/304.2
4,676,545 A * 6/1987 Bonfilio et al. ..... 296/193.04
4,915,665 A * 4/1990 Ming ..... 446/66
2003/0119417 A1 6/2003 Iwasawa

FOREIGN PATENT DOCUMENTS

JP 08112457 A 5/1996
JP 3313915 5/2002

* cited by examiner

*Primary Examiner*—John A. Ricci
(74) *Attorney, Agent, or Firm*—Woodling, Krost and Rust

(57) ABSTRACT

A changeable model flight toy which can simulate the takeoff and landing attitudes and flight attitudes at low cost in accordance with different types of airplanes is provided. A plurality of airplane bodies having different outer appearance forms which can be maintained for a long period of time are interchangeably mounted on an inner sleeve. A changeable model flight toy 100 characterized by a flight operation unit 120 which is incorporated within airplane bodies 110, 210 is disclosed. A takeoff and landing control panel 130 hoists and lowers the flight operation unit 120 while bearing the unit 120. The airplane body 110, 210 comprises a nose side body 110A, 210A including the main wing 112, 212 and a tail assembly side body 110B, 210B including the tail assembly 115, 215. The nose side body 110A, 210A and the tail assembly side body 110B, 210B of the airplane body 110, 210 are respectively detachably fitted from the nose side position and the tail assembly side position of the inner sleeve 140 which incorporates the flight operation unit 120 and surrounds it.

2 Claims, 6 Drawing Sheets

AIRPLANE TYPES CHANGEABLE MODEL FLIGHT TOY

This patent application claims priority to Japanese Pat. Appln. 2004-093707 filed Mar. 26, 2004.

TECHNICAL FIELD

This invention relates to an airplane model flight toy. More specifically, this invention relates to an airplane model flight toy which simulates the takeoff attitude and the flight attitude of the airplane. The toy includes a plurality of airplane bodies having different outer appearance for ms. The airplane bodies are replaceable and are interchangeable so that the user may select and play with various different style bodies.

BACKGROUND TECHNOLOGY

Flight toys such as model flight toy 500 are well known (see for example Patent Reference 1 which is Japanese Patent Publication No. 3313915). An airplane body 510 includes a nose side body 511 of a specified kind of airplane fitted to a rotating frame body 531 which is located in a front body portion thereof. Shaft rod 520 is fixed to the airplane body on the nose side. Tail side body 512 is fitted onto a rotating frame body 532 in a rear portion body and it is raised and lowered to simulate takeoff and landing. Takeoff and landing control panel 540 is used so as to simulate the takeoff and landing attitudes at the time of takeoff and landing, and airplane body 510, can simulate flight attitudes such as a level flight, a reverse flight, a rolling flight and the like by regularly and reversely rotating the risen airplane body 510.

Patent Reference 1 is the Publication of Japanese Patent No. 3313915.

PROBLEMS TO BE SOLVED BY THE INVENTION

However, in such conventional model flight toys 500, the body rotating frame 531 in the front body portion and the rotating frame body 532 in the rear portion include complicated operating mechanisms for simulating the takeoff and landing attitudes and flight attitudes such as a level flight, a reverse flight, a rolling flight and the like, which are respectively fitted to the nose side body 511 and the tail assembly side body 512. The conventional model flight toys comprise a specified kind of airplane body 510 and they are not meant to be disassembled.

Accordingly, when a different kind of an airplane body 510 having another outer appearance form is desired to be flight-simulated, an entirely new model flight toy which simulates the takeoff and landing attitudes and flight attitudes such as a level flight, a reverse flight, a rolling flight and the like must be purchased. Thus there is a problem of incurring considerable cost to buy a new model airplane toy for each airplane body type. Alternatively, when the toy is forcibly disassembled to avoid the cost of a new model airplane, parts are broken and a large repair cost is incurred and the airplane toy once repaired is not as good as the original structure and will not last for a long period of time.

The object of the present invention is to provide a changeable model flight toy which can simulate the takeoff and landing attitudes and flight attitudes at low cost. A plurality of interchangeable airplane bodies having different outer appearance forms of every type can be used which ensure reliable operation for a long period of time.

MEANS FOR SOLVING THE PROBLEMS

To attain the above-mentioned object, the invention includes a changeable model flight toy characterized by a plurality of airplane bodies having different outward appearance forms. A flight operation unit is incorporated within said airplane bodies and is in common therewith. A takeoff and landing control panel hoists and lowers said flight operation unit and the airplane body. The airplane body comprises a nose side body including the main wing which may be disassembled and assembled at the front of the device. The tail assembly side body includes the tail assembly and the tail wings. The nose side body and the tail assembly side body of the airplane body are respectively detachably fitted from the nose side position and the tail assembly side position.

The nose side body and the tail assembly body are mounted on a tapered inner sleeve.

According to the invention the inner sleeve has a tapered outer circumferential surface which is gradually reduced toward the nose side position and the tail assembly side position and which respectively fits the nose side body and the tail assembly side body from the bearing position.

According to the invention the above-mentioned problems are further solved in that inner sleeve is molded from a transparent synthetic resin.

EFFECTS OF THE INVENTION

The model flight toy according to the present invention comprises: a plurality of airplane bodies having different outward appearances; a flight operation unit incorporated within said airplane bodies in common therewith and a takeoff and landing control panel, which hoists and lowers said flight operation unit while bearing (supporting) the unit. Thus, the model flight toy according to the present invention can not only replace an airplane body to change the kind of the airplane, but also has the following peculiar effects.

That is the model flight toy of the present invention includes: a nose side body which comprises the main wings; and, a tail assembly side body including the tail assembly. Thus, even if the airplane bodies have different outer appearance forms the model flight toy can be separated in simple sections. Consequently, disassembling and assembling the parts can be easily performed during the changing of the bodies of the airplanes. Further, the airplane body can be balanced well.

Further, the nose side body and the tail assembly side body of the airplane body are detachable from the nose side position and the tail assembly side position. The inner sleeve incorporates the airplane operation unit and surrounds it. Thus, even if the airplane bodies have different outer appearance forms the nose side body and the tail assembly side body can be unitarily, uniformly, and detachably fitted to an inner sleeve. Consequently, airplane bodies separated from the flight operation unit can be easily and reliably interchanged with each other so that the takeoff and landing attitudes and flight attitudes in accordance with the kinds of airplanes can be simulated at low cost. And since a flight operation unit, which operates the flight attitudes such as level flight, reverse flight, rolling flight and the like is protected by being surrounded by an inner sleeve, the flight operation unit provided with a complicated operation mechanism cannot be broken at the time of changing the kinds of airplanes and the endurance of the airplane body can be maintained for a long period of time.

Further, according to the model flight toy of the present invention, the inner sleeve has a gradually tapered outer circumferential surface with slightly reduced diameters toward the nose side position and the tail assembly side position, which respectively fits the nose side body and the tail assembly side body from the bearing position. Thus, since the nose side body and the tail assembly side body of the airplane body are smoothly fitted onto each other through a tapered fitting outer circumferential surface of the inner sleeve, the fitting operation is easy at the time of changing the kinds of airplanes and the tapered fitting outer circumferential surface becomes a locking or a stopper after fitting, and the flight operation unit provided with a complicated operation mechanism cannot be broken.

Further, according to the model flight toy of the present invention, the inner sleeve is molded from a transparent synthetic resin. Thus, the operating conditions of the flight operation unit surrounded by this inner sleeve can be seen from the outside and easy maintenance can be attained.

A better understanding of the invention will be had when reference is made to the description of the invention and the claims which follow hereinbelow.

DESCRIPTION OF THE INVENTION

The present invention is a changeable model flight toy characterized by a plurality of airplane bodies having different outward appearance forms, a flight operation unit incorporated within the airplane bodies in common therewith and a takeoff and landing control panel, which hoists and lowers said flight operation unit while bearing the unit. The airplane body comprises a nose side body including the main wings and a tail assembly side body, which may be split so as to be disassembled and assembled at the front and the back of the bearing position. The tail assembly side body including the tail assembly and the nose side body are respectively detachably fitted from the tail assembly side position and nose assembly position of the inner sleeve (which incorporates said airplane operation unit and surrounds it). Thus, the model flight toy of the present invention can simulate the takeoff and landing attitudes and flight attitudes at low cost in accordance with different types of airplanes by easily and reliably replacing only a plurality of airplane bodies having different outer appearance forms with each other, and can maintain the endurance of the device for a long period of time.

For example, as the forms of sleeves into which the nose side body and the tail assembly side body are fitted, any one of cylindrical or square sectional tubular sleeves, through which these bodies can be fitted, may be used. Further, the outer appearance forms may take any of a singular wing airplane such as a 97 type combat plane and the like and a double wings airplane including upper and lower two main wings.

A model flight toy 100, which is one example of the present invention, will be described with reference to FIGS. 1 to 4.

Figure 1:
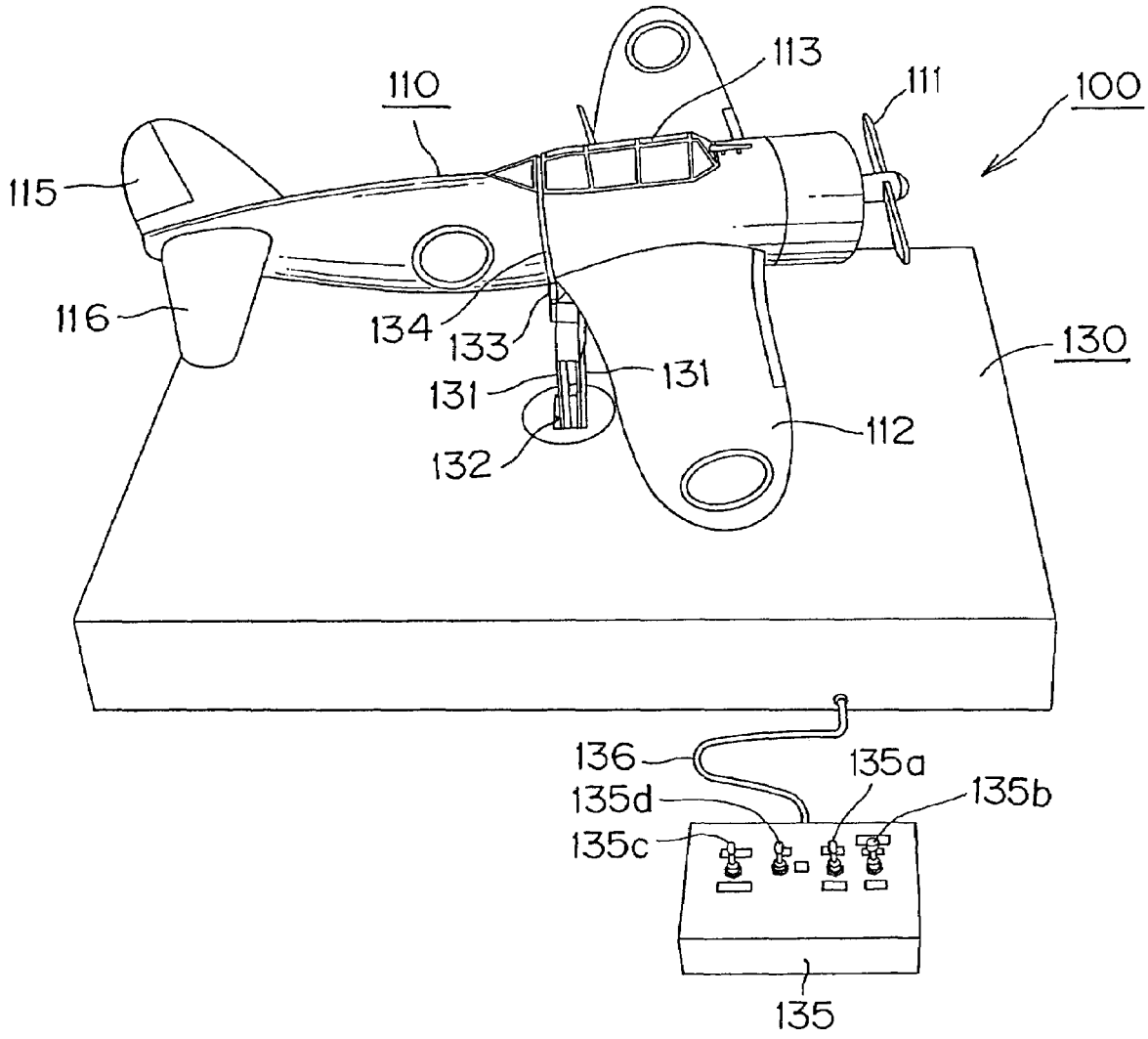
FIG. 1 is an entire schematic view of a model flight toy, which is one example of the present invention.
Figure 2:
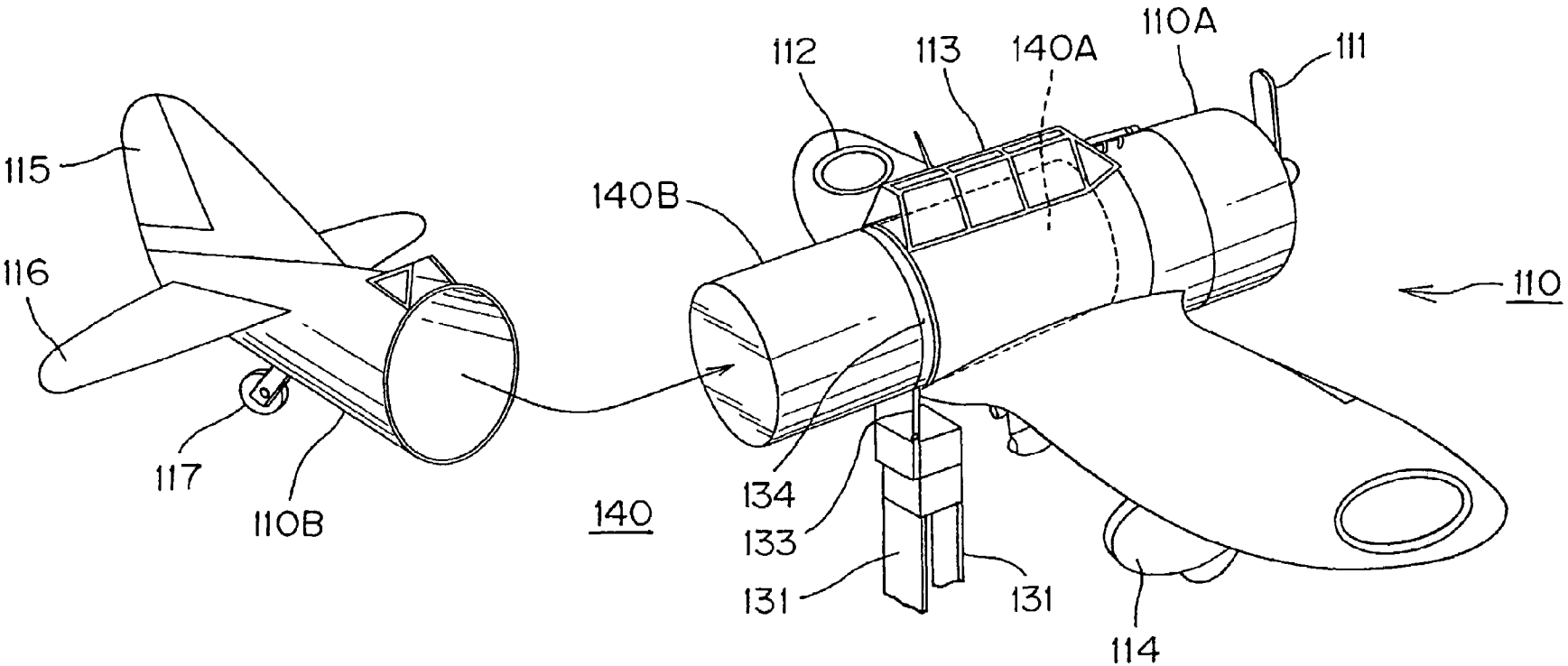
FIG. 2 is a perspective view in which a part of the airplane body shown in FIG. 1 was exploded.
Figure 3:
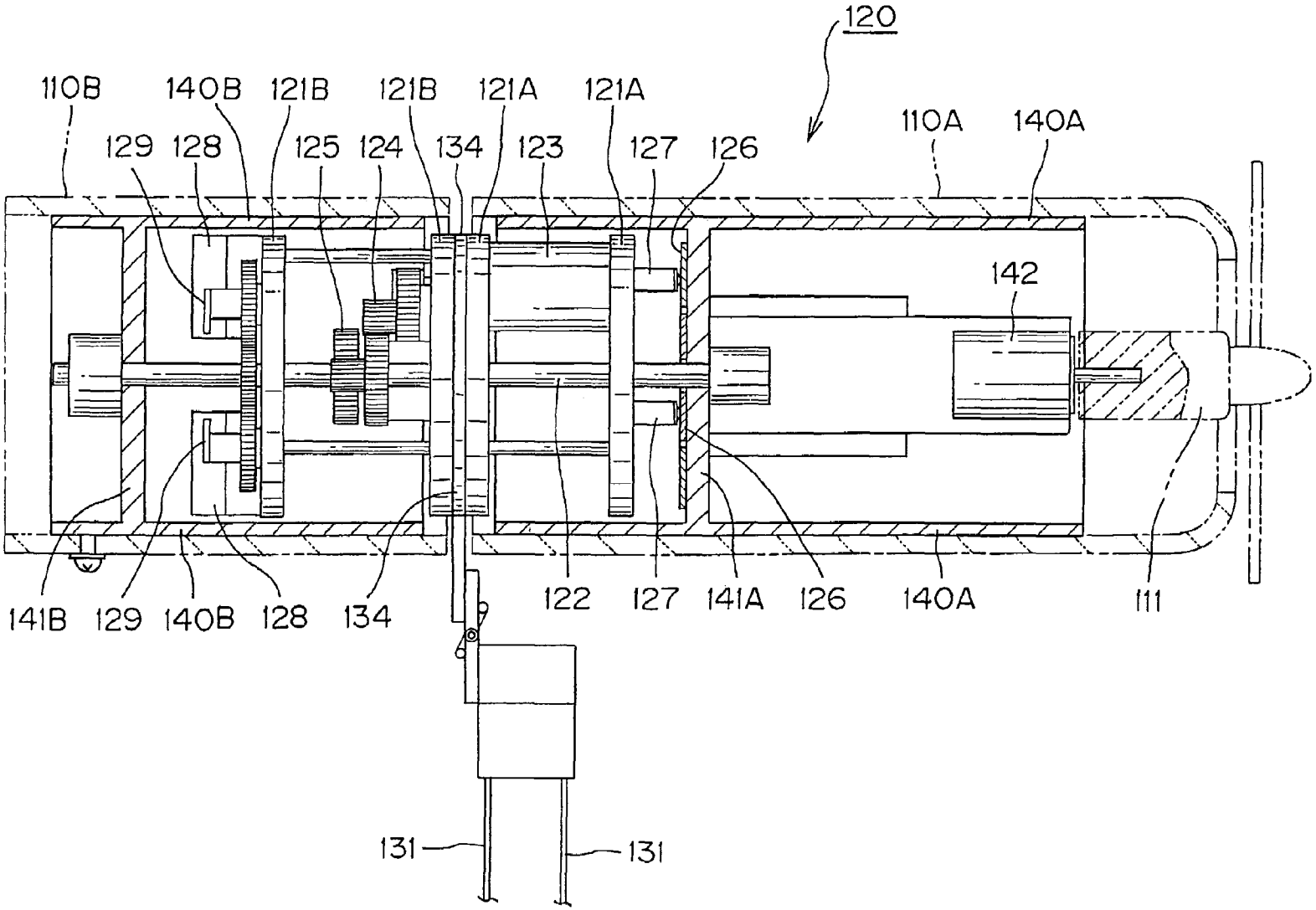
FIG. 3 is a longitudinal cross-sectional view taken along the line 3-3 of FIG. 2.
Figure 4:
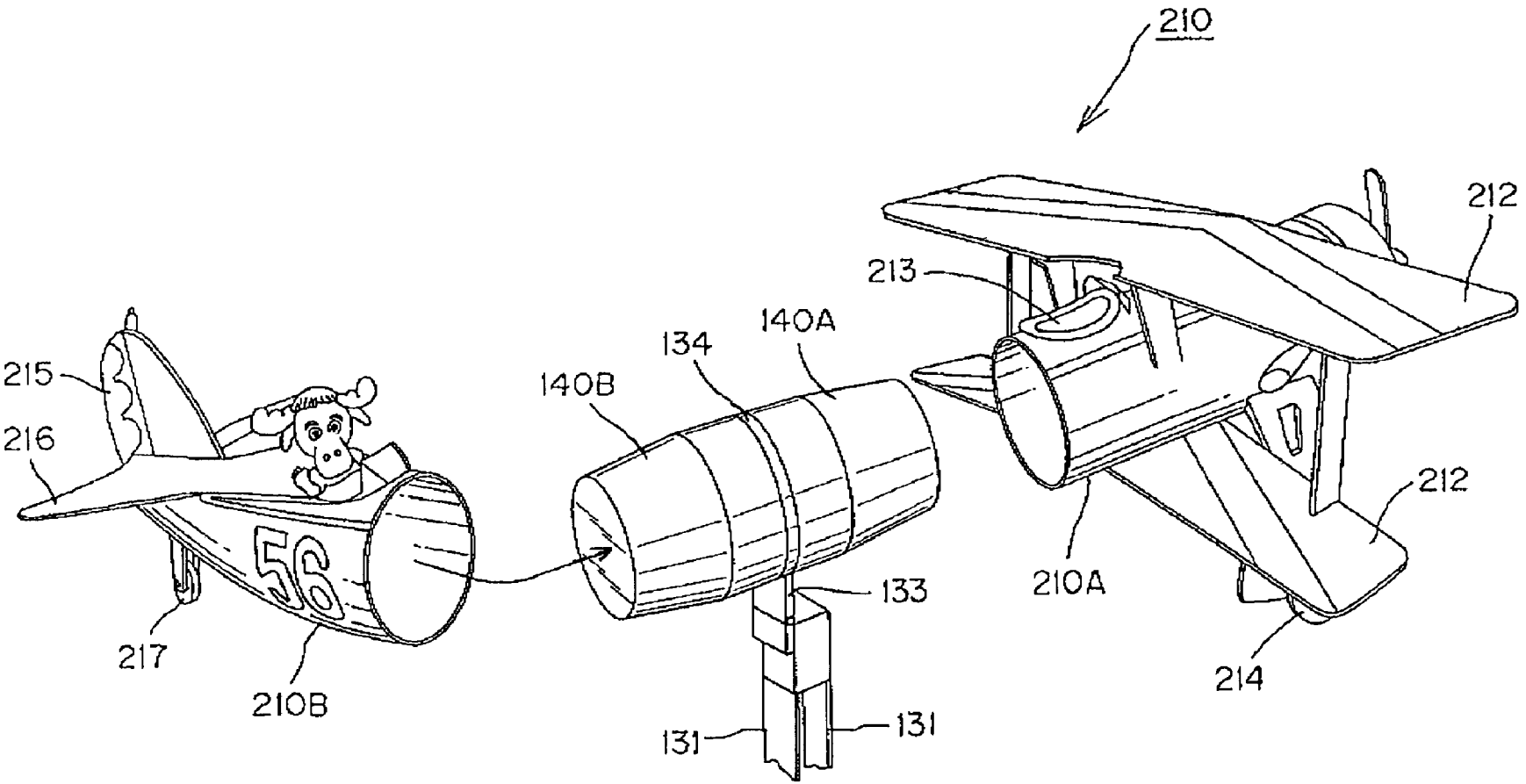
FIG. 4 is a perspective view in a case where the flight body shown in FIG. 2 is replaced with another kind of airplane.
Figure 5:
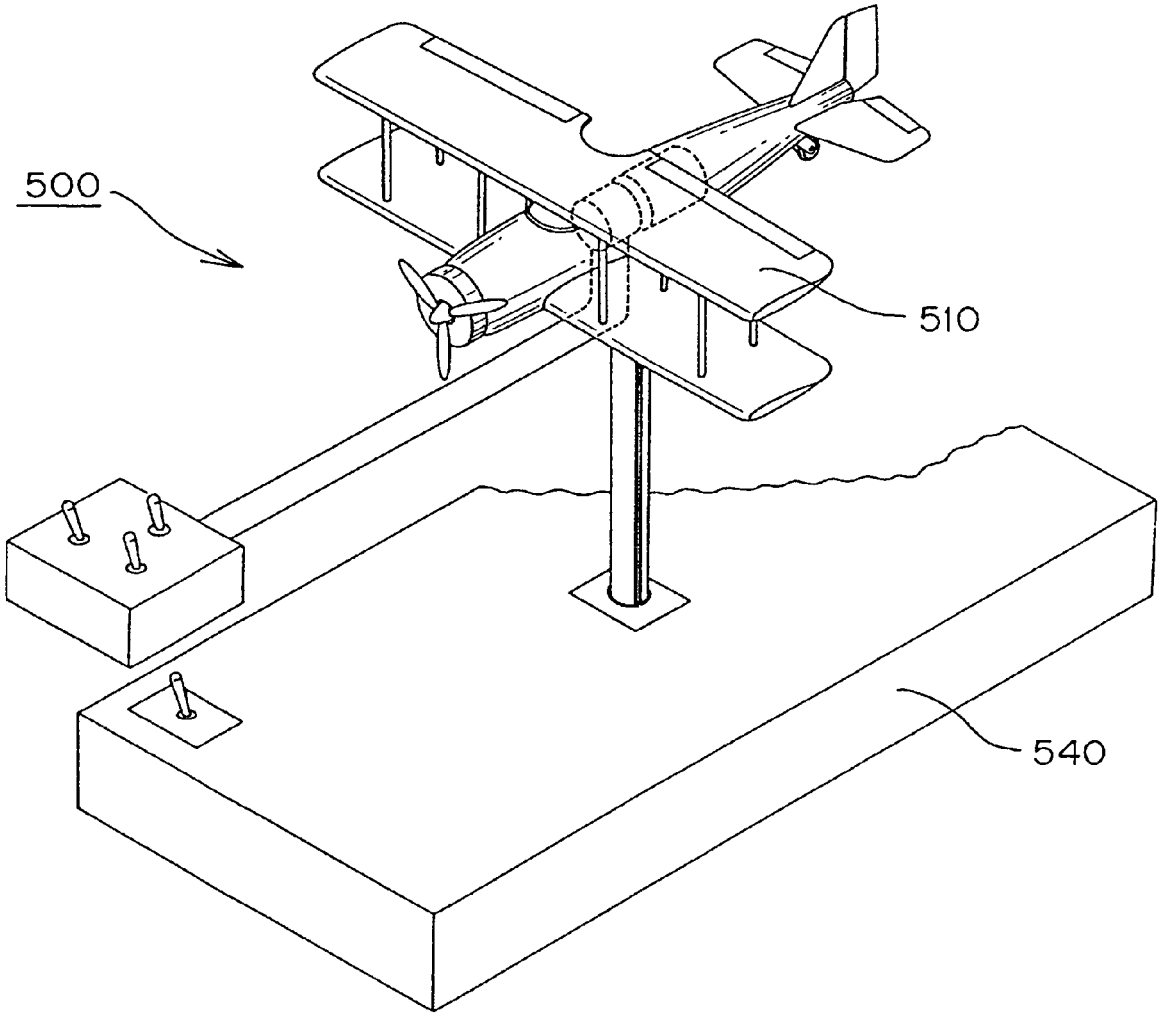
Fig. 5 Prior Art
FIG. 5 is an entire schematic view of a conventional model flight toy.
Figure 6:
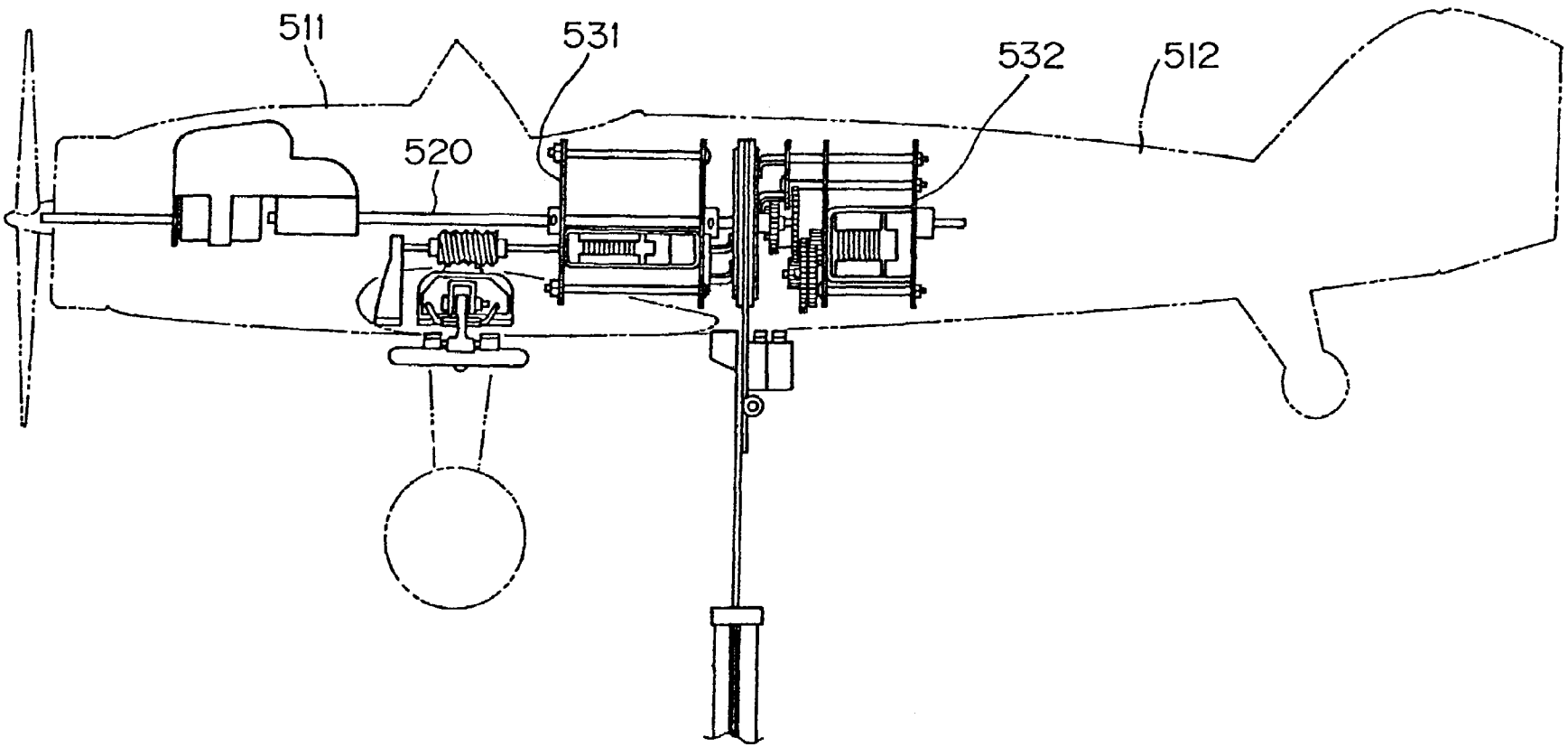
Fig. 6 Prior Art
FIG. 6 is an operation mechanism in the airplane body shown in FIG. 5.

FIG. 1 is an entire schematic view of a model flight toy, which is one example of the present invention, FIG. 2 is a perspective view in which a part of the airplane body shown in FIG. 1 was exploded, FIG. 3 is a longitudinal cross-sectional view taken along the line 3-3 of FIG. 2 and FIG. 4 is a perspective view in a case where the flight body shown in FIG. 2 is replaced with another kind of airplane body.

First, as shown in FIGS. 1 to 4, the model flight toy 100, which is one example of the present invention comprises a plurality of airplane bodies 110, 210 each having a different outer appearance form, a flight operation unit 120 incorporated with the airplane bodies 110, 210 and a takeoff and landing control panel 130, which hoists and lowers the flight operation unit 120 while bearing it.

In the case of the model flight toy 100 of the present example, an airplane body 110 comprising a single wing airplane imitating a 97 type combat plane is shown in FIGS. 1 and 2. A double winged airplane including upper and lower main wings as shown in FIG. 4 can be replaced with each other. Instead of these types the kinds of airplanes having peculiar outer appearance forms such as Zero (combat plane), Mustang, Spitfire, Messerschmitt and the like may be used.

The airplane bodies 110, 210 comprise nose side bodies 110A, 210A, and tail assembly side bodies 110B, 210B, respectively, as shown in FIGS. 2 and 3. The nose 110A, 210A and tail bodies 110B, 210B may be separated and may be disassembled at the front and rear positions of the bearing position of the airplane bodies 110, 210. The airplane bodies 110, 210 are replaced with each other by forming the opening diameters and the like of the nose side body 110A and nose side body 210A of different kinds of airplanes in the same opening forms and diameters. Similarly by forming the opening diameters and forms of the tail assembly side body 110B and tail assembly side body 210B in the same opening forms and diameters permits interchangeability of airplane bodies.

It is noted that the reference numeral 111 of the airplane body 110 in FIG. 2 denotes a propeller composed of an elastic body which has no contact accident during rotation of the propeller attached to the nose side body 110A. The reference numeral 112 indicates a main wing provided with the nose side body 110A, the reference numeral 113 indicates a cockpit provided with the nose side body 110A, the reference numeral 114 indicates a front leg provided with the main wing 112, the reference numeral 115 indicates a vertical tail assembly provided with the tail assembly side body 110B, the reference numeral 116 indicates a horizontal tail assembly provided with the tail assembly side body 110B, and the reference numeral 117 indicates a rear leg provided with the tail assembly side body 110B.

The reference numeral 211 of the airplane body 210 in FIG. 4 denotes a propeller provided with the nose side body 210A, the reference numeral 212 indicates a main wing provided with the nose side body 210A, the reference numeral 213 indicates a cockpit provided with the nose side body 210A, the reference numeral 214 indicates a front leg provided with the main wing 212, the reference numeral 215 indicates a vertical tail assembly provided with the tail assembly side body 210B, the reference numeral 216 indicates a horizontal tail assembly provided with the tail assembly side body 210B, and the reference numeral 217 indicates a rear leg provided with the tail assembly side body 210B.

And the nose side bodies 110A and 210A and the tail assembly side bodies 110B and 210B are respectively detachably fitted onto the nose side sleeve 140A disposed at a nose side position of a cylindrical inner sleeve 140 incorporating and surrounding the above-mentioned flight operation unit 120 and the tail assembly side sleeve 140B disposed at a tail assembly side position thereof. These nose side sleeve 140A and the tail assembly side sleeve 140B respectively include gradually reducing outer circumferential surfaces toward the nose side position and the tail assembly side position. Then at the time of changing the airplane bodies the nose side bodies 110A and 210A and the tail assembly side bodies 110B and 210B of the airplane bodies 110 and 210 are smoothly fitted onto the nose side sleeve 140A and the tail assembly side sleeve 140B, respectively, and the tapered outer circumferential surfaces lock and act as stoppers.

It is noted that although not shown, the nose side bodies 110A and 210A and the tail assembly side bodies 110B and 210B into which these nose side sleeve 140A and the tail assembly side sleeve 140B are respectively fitted, may be fixed screws. Further, in a case of fitting with a key groove, the above-mentioned locking and stopping can be not only perfectly attained, but also between the nose side sleeve 140A and the nose side bodies 110A, 210A or between the tail assembly side sleeve 140B and the tail assembly side bodies 110B, 210B there is not generated a mounting shift around the body so that the mounting can be performed in a correct position.

Further, since the inner sleeve is molded of a transparent synthetic resin, the operating conditions of the flight operation unit 120 surrounded by this inner sleeve 140 can be observed and easy timely maintenance can be performed. Additionally, direct contact breakage of the flight operation unit 120 formed of a complicated operating mechanism can be prevented in the when changing airplane bodies.

Further, the inner circumferential surface sides of the nose side sleeve 140A and tail assembly side sleeve B are respectively provided with a nose side partition wall 141A and a tail assembly side partition wall 141B. Further, the nose side sleeve 140A includes a propeller driving motor 142, which rotates a propeller 111.

Next, a concrete configuration of the flight operation unit 120 will be described with reference to FIG. 3.

The flight operation unit 120 comprises: a nose side fixing frame body 121A accommodated in the nose side sleeve 140A, a tail assembly side fixing frame body 121B accommodated in the tail assembly side sleeve 140B, a shaft rod 122 of the airplane body fixed to the nose side partition wall 141A and a tail assembly side partition wall 141B. The shaft rod 122 penetrates through the nose side fixing frame body 121A and the tail assembly side fixing frame body 121B. A flight driving motor 123 is attached to the nose side fixing frame body 121A, a planetary gears group 124 are mounted on the tail assembly side fixing frame body 121B, a sun gears group 125 are mounted on the shaft rod 122 of the airplane body, a fixed contact 126 is attached to the nose side partition wall 141A, a sliding contact 127 is attached to nose side fixing frame body 121A, a micro switch 128 is mounted on the tail assembly side fixing frame body 121B, and a cam member 129 are all illustrated in FIG. 3. The cam member 125 is rotated by a gear fixed to the shaft rod 122 of the airplane body.

Therefore, in the flight operation unit 120, when the flight driving motor 123 is rotated, the end gear in the planetary gears group 124 which links with this flight driving motor 123, rotates the shaft rod 122 of the airplane body through the sun gears group 125. Shaft rod 122 of the airplane body rotates the nose side sleeve 140A and the tail assembly side sleeve 140B through the nose side partition wall 141A and tail assembly side partition wall 141B. Further, the airplane body 110 is integrated with the nose side body 110A and the tail assembly side body 110B respectively fitted into these nose side sleeve 140A and the tail assembly side sleeve 140B, is rotated around the shaft center of the shaft rod 122 of the airplane body. Accordingly, the airplane body 110 can simulate flight attitudes such as level flight, reverse flight, rolling flight and the like.

It is noted that the nose side sleeve 140A includes a propeller driving motor M1. The propeller driving motor M1 is energized through the fixed contact 126 attached to the nose side partition wall 141A and the sliding contact 127 attached to the nose side fixing frame body 121A. This electricity is supplied from the above-mentioned takeoff and landing control panel 130 through a conducting cable as in the flight driving motor 121A.

Further, the rolling angle in rolling flight of the airplane body 110 is controlled by turning electrical contact to the flight driving motor 123 on or off with the micro switch 128 mounted on the tail assembly side fixing frame body 121B and the cam member 129, which is rotated by the gear fixed to the shaft rod 122 of the airplane body.

Next, the takeoff and landing control panel 130 includes a hoisting and lowering operation mechanism, which hoists and lowers the flight operation unit within the airplane body 110.

That is, in a housing of the takeoff and landing control panel 130 is provided a flexible accommodating means of an upright bearing support 131 as disclosed in the specification of Japanese patent No. 3313915. This flexible accommodating means comprises, although not shown, a hoisting and lowering driving motor, which is driven and stopped by a switch operation. Screw shafts having a right screw portion and a left screw portion, which are rotated by the hoisting and lowering driving motor. Movable tops are screwed with the respective screw portions of this screw shaft. A guide rod moves the movable tops linearly without rotating the tops. A pair of straightening rollers makes the upright bearing support 131 formed in a concave curve by a curve guide hole penetrated on an upper surface of the housing a flexible flat-shaped one.

Therefore, when the movable tops, which are connected to lower ends of the upright bearing support 131, are moved toward each other by the rotation of the screw shafts by the hoisting and lowering driving motor, the upright bearing support 13 formed in a concave curve and provided with upright rigidity is lowered to be press-sandwiched between the pair of straightening rollers so that the shape of the support is a flexible flat one. Thus, as the movable tops are moved the upright bearing support 131 is drawn in the horizontal direction along the screw shafts to be accommodated into the housing. Further, when the screw shafts are rotated in a direction where the movable tops approach each other, the upright bearing support 131 becomes a curved one after passing through the curve guide hole whereby it is provided with upright rigidity to be hoisted.

The upper end portion of the upright bearing support 131 formed in a concave curve and is provided with the upright rigidity by the curve guide hole provided on the upper surface of the housing in a penetrated manner. A backward-bendably hinged airplane body-supporting plate 134 is mounted using hinge plate 133 located at a slightly rear position from the position of gravity of the airplane body 110. The airplane body supporting plate 134 is fixed to the above-mentioned nose side fixing frame body 121A and the tail assembly side fixing frame body 121B so that it bears the flight operation unit 120.

Further, as shown in FIG. 1, the takeoff and landing control panel 130 is connected a controller 135, which controls the takeoff and landing attitudes and the flight attitudes of the airplane body 110 through an electrical cable 136. This controller 135 includes a power source switch 135*a*, an engine switch 135*b*, a rolling switch 135*c* and a takeoff and landing switch 135*d*.

The engine switch 135*b* controls the number of revolutions of the propeller driving motor 142, the rolling switch 135*c* controls the direction of rotation of the rolling motor, and the takeoff and landing switch 135*d* controls the degrees of the hoisting and lowering of the upright bearing support 131.

According to the thus obtained model flight toy 100 of the present example, the kinds of airplanes can be changed by only replacing an airplane body 110 composed of a single wing airplane with an airplane body 210 composed of a plurality of wings airplane without replacing any other components. Further, even if these airplane bodies 110 and 210 have different outer appearance forms, they can be separated in a simple sectional form while avoiding the disassembly of protruded portions such as a main wing and a tail assembly. Thus, the disassembly and assembly can be easily performed at the time of changing the bodies of the airplanes.

Further, according to the model flight toy 100 of the present example, even if the airplane bodies have different outer appearance forms, the nose side body and the tail assembly side body can be unitarily, uniformly, detachably fitted through an inner sleeve 140. Consequently, airplane bodies 110, 210 separated from the flight operation unit 120 can be easily and reliably interchanged so that the takeoff and landing attitudes and flight attitudes in accordance with the kinds of airplanes can be simulated at low cost. And since the flight operation unit 120, which operates the flight attitudes such as level flight, reverse flight, rolling flight, and the like is protected by being surrounded by an inner sleeve, the flight operation unit 120 provided with a complicated operation mechanism cannot be broken at the time of changing the airplane bodies and the endurance of the components can be maintained for a long period of time. These effects are very large.

DESCRIPTION OF REFERENCE NUMERALS

100 . . . Model flight toy
110, 210 . . . Airplane body
110A, 210A . . . Nose side body
110B, 210B . . . Tail assembly side body
111, 211 . . . Propeller
113, 213 . . . Main wing
114, 214 . . . Cockpit
115, 215 . . . Vertical tail assembly (rudder)
116, 216 . . . Horizontal tail assembly
117, 217 . . . Rear leg
120 . . . Flight operation unit
121A, 221A . . . Nose side fixing frame body
121B, 221B . . . Tail assembly side fixing frame body
122 . . . Shaft rod of airplane body
123 . . . flight driving motor
124 . . . Planetary gears group
125 . . . Sun gears group
126 . . . Fixed contact
127 . . . Sliding contact
128 . . . Micro switch
129 . . . Cam member
130 . . . Takeoff and landing control panel
131 . . . Upright bearing support
132 . . . Curve guide hole
133 . . . Hinge plate
134 . . . Airplane body supporting plate
135 . . . Controller
135*a* . . . Power source switch
135*b* . . . Engine switch
135*c* . . . Rolling switch
135*d* . . . Takeoff and landing switch
136 . . . Electrical cable
140 . . . Inner sleeve
140A . . . Nose side sleeve
140B . . . Tail assembly side sleeve
141A . . . Nose side partition wall
141B . . . Tail assembly side partition wall
142 . . . Propeller driving motor
510 . . . Airplane body
511 . . . Nose side body
512 . . . Tail assembly body
520 . . . Shaft rod of airplane body
531 . . . Rotating frame body in front portion body
532 . . . Rotating frame body in rear portion body
540 . . . Takeoff and landing control panel While the invention has been described herein by way of examples those skilled in the art will readily recognize that changes may be made to the invention without departing from the spirit and scope of the appended claims.

The invention claimed is:

1. A model airplane flight toy characterized by a plurality of airplane bodies having different outward appearances in the shape of different airplanes, a flight operation unit residing within said airplane bodies, a takeoff and landing control panel which hoists and lowers said flight operation unit, each of said airplane bodies comprise a nose side body including the main wing and a tail side body including the tail assembly, an inner sleeve, said inner sleeve includes a nose side portion and a tail side portion, said nose side body detachably fitted on said nose side portion of said inner sleeve and said tail side body detachably fitted on said tail side portion of said inner sleeve, said inner sleeve includes said flight operation unit, said inner sleeve surrounding said flight operation unit, said inner sleeve has a tapered fitting outer circumferential surface gradually reducing in diameter toward said nose side and said tail side which respectively receives and fits said nose side body and said tail side body, and, each said nose side body and each said tail side body of said airplane body are respectively detachably fitted from said nose side portion and said tail side portion of said inner sleeve thereby enabling interchangeability of one of said plurality of airplane bodies with another.

2. A model airplane flight toy according to claim 1 characterized in that said inner sleeve is molded from a transparent synthetic resin.

* * * * *